US005271130A

United States Patent [19]

Batra

[11] Patent Number: 5,271,130

[45] **Date of Patent: * Dec. 21, 1993**

[54] LACING SYSTEM FOR SHOES

[75] Inventor: Vijay K. Batra, Nashua, N.H.

[73] Assignee: K-Swiss Inc., Pacoima, Calif.

[ * ] Notice: The portion of the term of this patent subsequent to Feb. 9, 2010 has been disclaimed.

[21] Appl. No.: 14,846

[22] Filed: Feb. 8, 1993

Related U.S. Application Data

[63] Continuation of Ser. No. 793,560, Nov. 18, 1991, Pat. No. 5,184,378.

[51] Int. Cl.[5] ..... A43B 11/00

[52] U.S. Cl. ..... 24/714.6; 24/714.8; 36/50.1

[58] Field of Search ..... 24/714.6, 714.8, 714.9, 24/306, 713–713.5, 442; 36/50.1, 51

[56] References Cited

U.S. PATENT DOCUMENTS

| | | | |
|---|---|---|---|
| 4,215,493 | 8/1980 | Antonious | 36/51 |
| 4,282,657 | 8/1981 | Antonious | 24/306 |
| 4,308,672 | 1/1982 | Antonious | 36/50.1 |
| 4,366,631 | 1/1983 | Larsen et al. | 36/50.1 |
| 4,451,995 | 6/1984 | Antonious | 36/51 |
| 4,901,452 | 2/1990 | Wang | 36/50.1 |
| 5,042,120 | 8/1991 | Nichols | 24/714.9 |

FOREIGN PATENT DOCUMENTS

| | | | |
|---|---|---|---|
| 0597297 | 5/1934 | Fed. Rep. of Germany | 36/50.1 |
| 0644373 | 4/1937 | Fed. Rep. of Germany | 36/50.1 |
| 0399394 | 6/1909 | France | 24/714.6 |
| 1087129 | 2/1955 | France | 24/714.6 |
| 0031292 | 1/1966 | German Democratic Rep. | 36/50.1 |
| 0014356 | of 1885 | United Kingdom | 36/50.1 |

*Primary Examiner*—Victor N. Sakran
*Attorney, Agent, or Firm*—Drucker & Sommers

[57] ABSTRACT

The invention is a lacing system for shoes employing a plurality of strips, wherein the lower ends of the strips are rigidly attached to the lower portion of the shoe and the upper portion of the strips have a lacing ring fixed thereto. The upper ends of the strips are slideably retained by loops on the upper of the shoe, and the middle portion of the strips are unattached to the quarter of the shoe. The strips transfer the lacing force evenly along the quarter to mold the quarter of shoe evenly to the wearer's feet.

13 Claims, 4 Drawing Sheets

Fig. 5
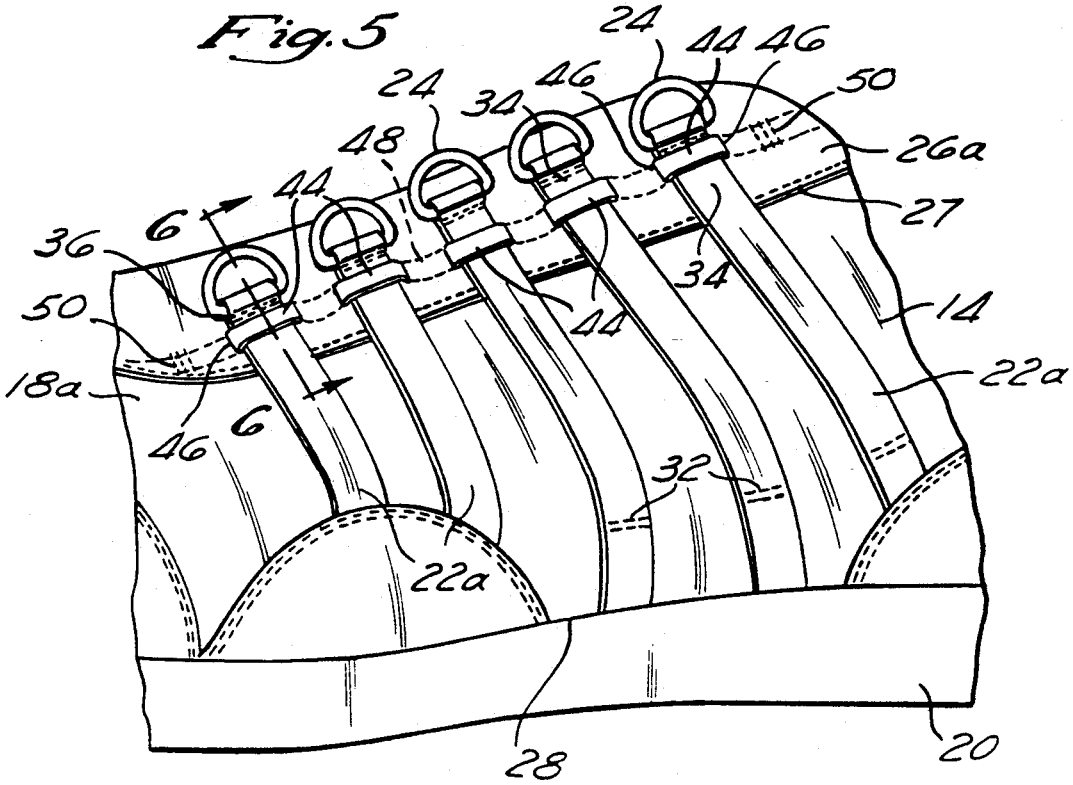
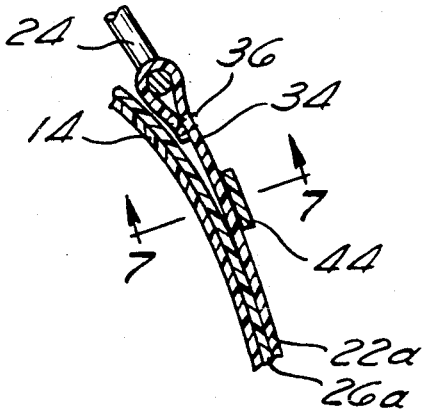
Fig. 6
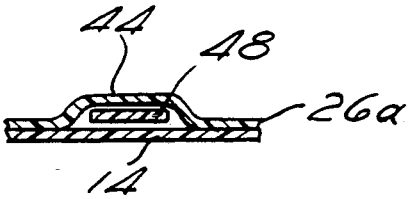
Fig. 7

Fig. 12
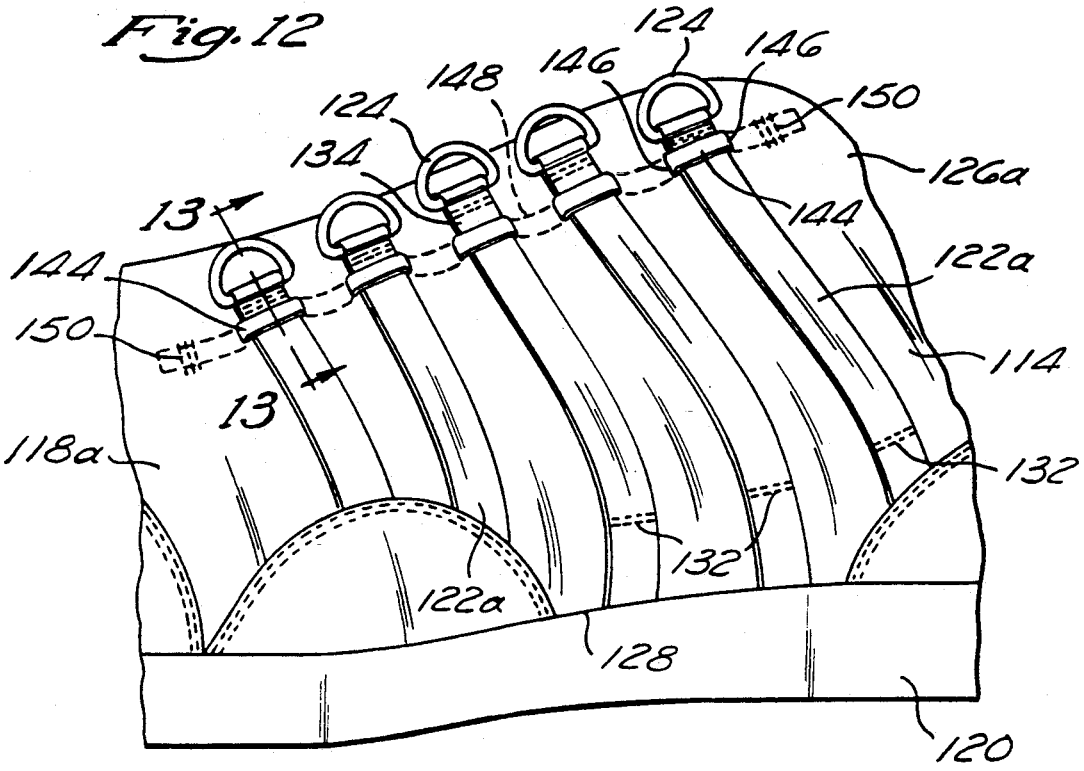
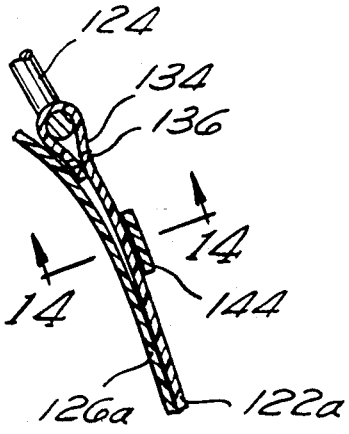
Fig. 13
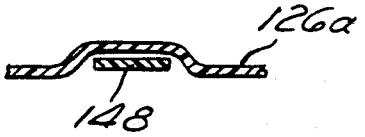
Fig. 14

LACING SYSTEM FOR SHOES

CROSS REFERENCE TO RELATED APPLICATIONS

This is a continuation of Ser. No. 07/793,560 to Vijay K. Batra, filed Nov. 18, 1991 now U.S. Pat. No. 5,184,378.

FIELD OF THE INVENTION

This invention relates generally to the field of lacing systems for shoes, particularly to a system employing strips, straps, or other support members, to which are affixed lacing eye members.

DESCRIPTION OF THE PRIOR ART

Prior art lacing systems have employed lacing rings or eyelets, through which the shoe laces are laced, positioned in the vicinity of the central longitudinal axial line of the shoe.

These prior art lacing systems generally comprise strips of material affixed to the uppers of the shoe and the lacing eyelets are, in turn affixed to the medial or inner, ends, of the strip so as to form a series of lacing eyelets adjacent to, and parallel to the central longitudinal axial line of the shoe. The strips of material are affixed to the shoe upper usually by stitching along their length—which of course is labor intensive and costly. Also, such prior art lacing systems will sometimes not mold perfectly to the wearer's foot because the stitching tends to rigidify the upper somewhat, and it is not as flexible as it should be for a perfect fit about the upper portions of the foot. Unsightly wrinkling of the uppers may also occur.

There is accordingly a need for a less expensive lacing system, which, preferably, allows the laces to better form or mold the shoe upper to the wearer's foot.

SUMMARY OF THE INVENTION

The invention disclosed herein solves the problems outlined above by providing a lacing system for a shoe having an upper with a vamp, a quarter on each side of the shoe and a counter, and a sole comprising:

a plurality of elongate strips, each strip having a lower portion, an upper portion, and a middle portion, said lower strip portion being rigidly attached near the quarter of the shoe in the vicinity of the sole of the shoe;

a plurality of lace eye members at least equal in number to said number of said plurality of strips, one of said lacing eye members being fixed at said upper portion of each said strips; and a plurality of loop means equal in number to said number of said strips, said plurality of loop means being fixed to the upper of the shoe alongside the central longitudinal axis thereof, wherein each said strip is movably retained at its upper portion by one loop means and at least said middle portion of said strips lies unattached on the quarter of the shoes.

There are several preferable ways in which the loop members may be affixed to the uppers of the shoe. Slits in the upper may be made which are parallel to the elongate strips, the material between the parallel slits forming the loop member. An additional eye stay material may be stitched to the upper along side the central longitudinal axis, and the loop members formed therefrom. Still further, the loop members may be formed from a third different material, stably positioned onto the uppers.

BRIEF DESCRIPTION OF THE DRAWING

The lacing system is described below in greater detail with respect to the accompanying drawings wherein:

FIG. 5 is a side elevational, fragmentary view shoe having a second embodiment of the new lacing system of the instant invention;

FIG. 6 is a cross-sectional view taken along lines 6—6 of FIG. 5 showing one strip and its lacing ring being retained by a loop member;

FIG. 7 is a cross-sectional view taken along lines 7—7 of FIG. 6 showing a portion of a lanyard covered by the eye stay;

FIG. 12 is a side elevational, fragmentary view of a shoe having a fourth embodiment of the new lacing system of the instant invention;

FIG. 13 is a cross-sectional view taken along lines 13—13 of FIG. 12 showing one strip and its lacing ring being retained loop member; and FIG. 14 is a cross-sectional view taken along lines 14—14 of FIG. 13 showing a portion of a lanyard covered by the eye stay.

DESCRIPTION OF THE PREFERRED EMBODIMENT

Figure 1:
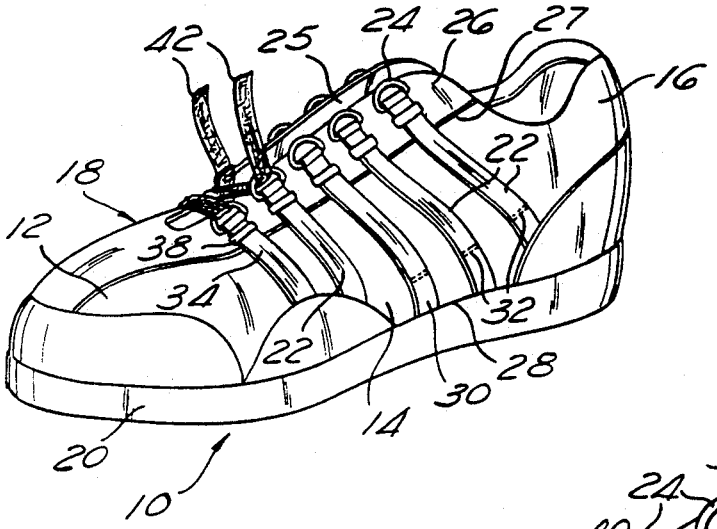
FIG. 1 is a perspective view of a shoe having a first embodiment of the new lacing system of the instant invention.
Figure 2:
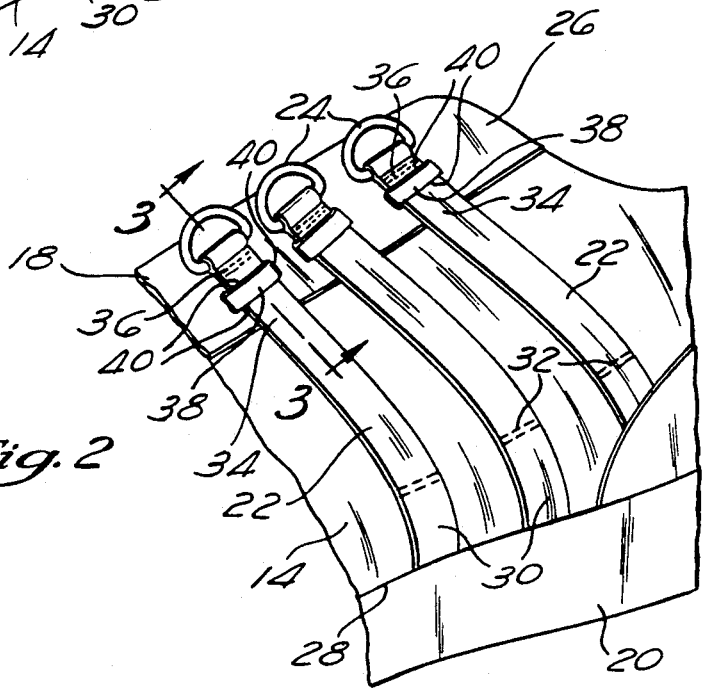
FIG. 2 is an enlarged fragmentary view, in perspective, of the lacing system shown in FIG. 1.
Figure 3:
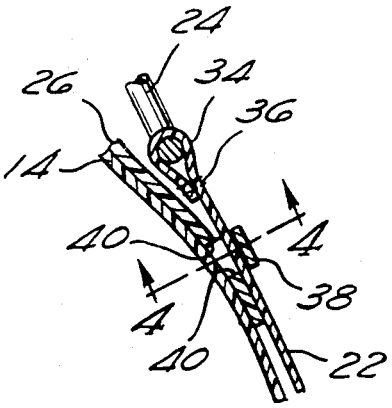
FIG. 3 is a cross-sectional view taken along lines 3—3 of FIG. 2 showing one strip and its lacing eyelet being retained by a loop member.
Figure 4:
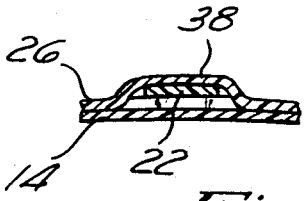
FIG. 4 is a cross-sectional view taken along lines 4—4 of FIG. 3, showing a loop member retaining a strip.
Figure 8:
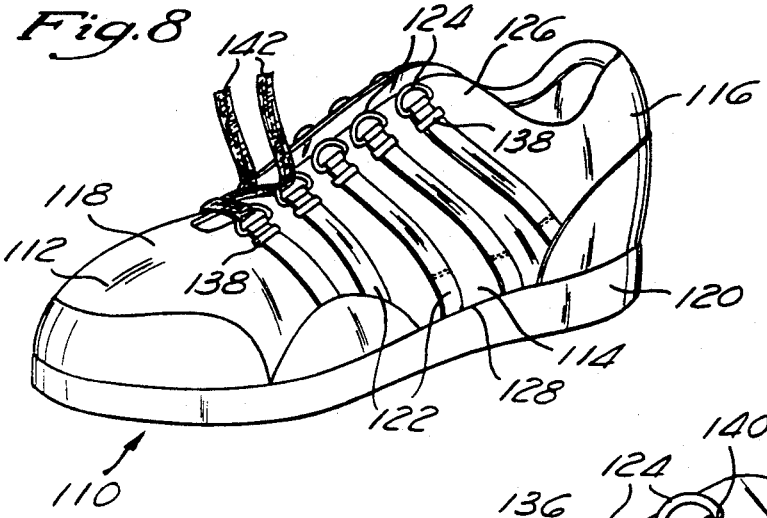
FIG. 8 is a perspective view of a third embodiment of the invention without an eye stay member.

As shown in FIG. 1, a shoe 10 respectively, has a front the portion, termed a vamp 12, a mid-section, called a quarter 14, and a rear section where the heel and lower ankle seat, known as the counter 16. The vamp 12, quarter 14 and counter 16 are collectively, in the art, known as the upper 18 of the shoe. The upper 18 is attached to the sole 20 of the shoe by adhesive, glue, stitching, molding under heat and pressure, or other means.

As shown in FIGS. 1–7, a plurality of nylon, leather, canvas or other essentially non-elastic strips 22 are utilized in the lacing system to transfer the lacing force evenly on the quarter 14, and thereby evenly mold the upper of the shoe to the foot. Attached to the upper end of each strip 22 is a lacing eye member or ring 24 which lies adjacent to an eye stay area 25 of the shoe alongside the medial longitudinal axis of the shoe. The lacing eye member 24 can be circular in shape or can have a D-ring or oval shape or any other desired shape. An additional layer of material forms a loop member piece 26 and **26*a***.

The loop member piece 26 and 26a, which may be made of leather, canvas, nylon, vinyl, or other materials is stitched to the top of the quarter in the region of the tongue of the shoe (not shown) along line 27. The loop member piece 26 is optional.

The strips 22 are fixedly attached in the vicinity of the lower portion 28 of the shoe where the sole 20 joins the upper 18. If desired, the strips 22 may also be stitched to the side of the quarter 14 at its lower portion 30 by one or more stitch lines 32 located in the vicinity of the lower portion 28 of the shoe where the sole 20 joins the upper 18. These groups of stitches 32 provide additional anchoring support of the strips 22 to the upper 18. As best shown in FIGS. 2, 3, 5 and 6, the upper end 34 of the strips 22 are folded over a lacing eyelet 24 and are stitched around the lace rings 24 by stitching lines 36.

In the first embodiment of the lacing system, shown in FIGS. 1–4, loops 38 are formed by a series of pairs of parallel slits 40 made through the loop member piece 26, the slits 40 running generally perpendicular to the direction of the strips 22. The upper portion of the strips 34 are slideably retained by the loops 38 formed by the material of the loop member piece 26 lying between the slits 40 through which the strips 22 pass. The laces 42 pass through the lacing eye members 24 in a conventional manner.

In the second embodiment of the lacing system, shown in FIGS. 5–7, a series of loops 44 are formed by pairs of parallel slits 46 cut through a loop member piece 26a, each slit 46 being approximately parallel to the direction of the strips 22a. A lanyard or narrow band or strap 48 is threaded through the slits 46. The ends of the lanyard 48 are stitched to the loop member material 26a and to the uppers 18a by groups of stitches 50. The loops 44 defined by the slits 46 and strap 48 are used to retain the upper portion of the strips 34. With this alternate loop forming means, the characteristics of the material used for the strap 48 can be selected to be the same or different than that of the material of the loop member 26. For example, the color of the lanyard 48 can be chosen to offset from the color of the loop member piece 26a.

As shown in FIGS. 8–11, a plurality of nylon, leather, canvas or other essentially non-elastic strips 122 are utilized in a third embodiment of the lacing system to transfer the lacing force evenly on the quarter 114, and thereby evenly mold the upper of the shoe to the foot. Attached to the upper end of each strip 122 is a lacing eye member or ring 124 which lies adjacent to a loop member area 126, alongside the medial longitudinal axis of the shoe. The lacing eye member 124 can be circular in shape or can have a D-ring or oval shape or any other desired shape.

Figure 9:
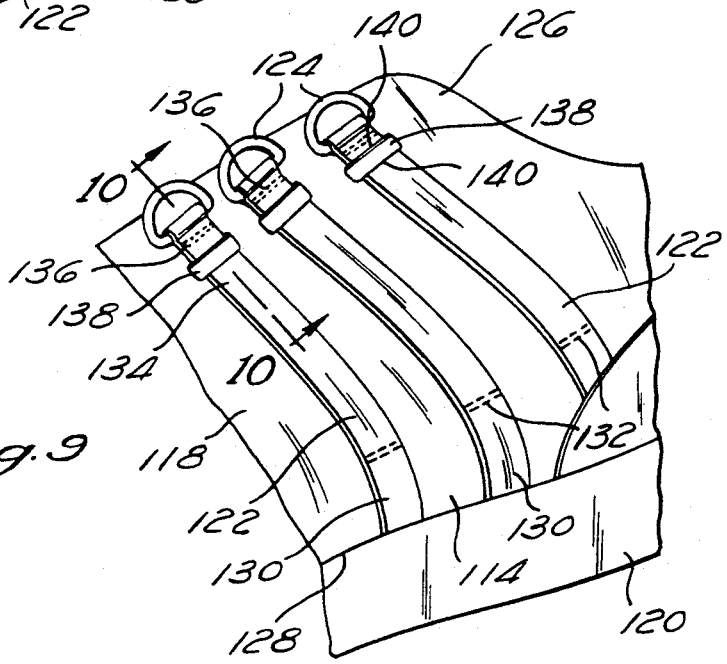
FIG. 9 is an enlarged fragmentary view, in perspective, of the lacing system shown in FIG. 8.
Figure 10:
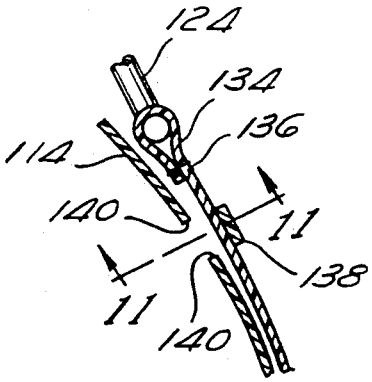
FIG. 10 is a cross-sectional view taken along lines 10—10 of FIG. 9 showing one strip and its lacing eyelet being retained by a loop member formed out of the material of the upper.
Figure 11:
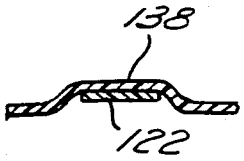
FIG. 11 is a cross-sectional view tubes along lines 11—11 of FIG. 10, showing a loop member retaining a strip.

The strips 122 are fixedly attached in the vicinity of the lower portion 128 of the shoe where the sole 120 joins the upper 118. If desired, the strips 122 may also be stitched to the side of the quarter 114 at its lower portion 130 by one or more stitch lines 132 located in the vicinity of the lower portion 128 of the shoe where the sole 120 joins the upper 118. These groups of stitches 132 provide additional anchoring support of the strips 122 to the upper 118. As best shown in FIGS. 9 and 10 the upper end 134 of the strips 122 are folded over a lacing eyelet 124 and are stitched around the lace rings 124 by stitching lines 136.

In the third embodiment of the lacing system, loops 138 are formed by a series of pairs of parallel slits 140 made directly through the loop member area 126, the slits 140 running generally perpendicular to the direction of the strips 122. The upper portion of the strips 134 are slideably retained by the loops 138 formed by the material of the loop member area 126 lying between the slits 140 through which the strips 122 pass. The laces 142 pass through the lacing eye members 124 in a conventional manner. The first and third embodiments are similar except that in the third embodiment, the slits 140 are made directly through the loop member area 126, while in the first embodiment, the slits 40 are made through the loop member piece 26 which lies atop the quarter 14.

In the fourth embodiment of the lacing system, similar to the second embodiment, shown in FIGS. 12–14, a series loops 144 are formed by pairs of parallel slits 146 cut directly through the loop member area 126a of the quarter 114 of the shoe in the vicinity of the medial longitudinal axis, each slit 146 being approximately parallel to the direction of the strips 122a. A lanyard or narrow band or strap 148 is threaded through the slits 146. The ends of the lanyard 148 are stitched to the loop member area 126a of the uppers 118a by groups of stitches 150. The loops 144 defined by the slits 46 and strap 148 are used to retain the upper portion of the strips 134. With this alternate loop forming means, the characteristics of the material used for the strap 148 can be selected to be the same or different than that of the material of the quarter 114. For example, the color of the lanyard 148 can be chosen to offset from the quarter 114.

In all four embodiments, the strips 22, 22a, 122, and 122a can slide or move relative to the uppers 18, 18a, 118, and 118a of the shoe, while being retained by loops 38, 44, 138 and 144. The new lacing system recited herein provides the advantages of the prior art lacing ring lacing system, and additionally, due to the fact that the strips 22, 22a, I22 and 122a are not stitched to the sides of the quarter section (except optionally near the lower part thereof), aids in more effectively smoothly molding the shoe to the foot (without wrinkling of the upper).

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

I claim:

1. A lacing system for a shoe having an upper with a vamp, a quarter on each side of the shoe, a counter, and a sole, comprising:

a plurality of elongate strips, each strip having a lower portion, an upper portion, and a middle portion, said lower strip portions being rigidly attached to the quarter of the shoe near the sole of the medial and lateral sides of the shoe;

a plurality of lacing eye members at least equal in number to said number of said plurality of strips, one of said lacing eye members being fixed at said upper portion of each of said strips; and a plurality of loop means equal in number to said number of said strips, said plurality of loop means comprising a plurality of pairs of spaced apart parallel slits made either through a loop member piece positioned along the medial longitudinal axis of the shoe, or directly through the quarter of the shoe lying along the medial longitudinal axis of the shoe, said pairs of slits running in a direction approximately parallel to said elongate strips, and a pair of lanyards, said lanyards being positioned on said shoe such that portions of the lanyards, not lying between said pair of slits, lie under the loop member piece or under the quarter of the shoe, and portions of the lanyard lying between said pairs of slits form said loops, wherein each said strip is movably retained at its upper portion by one loop means and at least a portion of sad middle portion of said strips lies unattached on the quarter of the shoe.

2. The lacing system for shoes of claim 1, wherein each of said strips are fixedly attached near the lower portion of the shoe by a means used to attach the soles of the shoes to the upper of the shoe.

3. The lacing system for shoes of claim 1, wherein at least one of said number of strips is permanently fixed at its lower portion to a lower portion of the quarter of the shoe by stitches.

4. The lacing system for shoes of claim 1, wherein said lacing rings are attached to each said upper portion of said strips by virtue of the upper portion of the strips being looped through and folded over a portion of the lacing ring, and the overlapped layers of the strips being sewn together.

5. A lacing system for a shoe having an upper with a vamp, a quarter, and a counter, a loop member attached to the upper in the vicinity of a tongue of the shoe, and a sole, comprising:

a plurality of elongate strips, each strip having a lower portion, an upper portion, and a middle portion, said lower portion being rigidly attached to the quarter of the shoe near the sole of the shoe;

a plurality of lacing eye members, at least one of said lacing eye members being fixed at said upper portion of each said strip; and a plurality of loop means equal in number to said number of said strips, each of said loops comprising a pair of spaced apart parallel slits formed through said loop member, said slits being approximately perpendicular to said elongate strips, wherein said upper portion of each said strip is slideably retained by one of said plurality of loops and at least a portion of said middle portion of said strips ride unattached on said quarter of the shoe.

6. The lacing system for shoes of claim 5, wherein at least one of each said strips is permanently fixed at its lower portion to a lower portion of the quarter of the shoe by stitches.

7. The lacing system for shoes of claim 5, wherein said lacing eye members are attached to each said upper portion of said strips by virtue of the upper portion of the strips being looped through and folded over a portion of the lacing eye member, and the overlapped layers of the strips being sewn together.

8. In a shoe having a sole, an upper, a plurality of elongate strips having an upper end and a lower end with lacing eye members affixed at said upper end, and shoe laces, the improvement comprising:

said plurality of elongate strips being retained on the shoe at said upper and lower ends thereof by an upper loop means and a lower retention means respectively, said upper loop means and lower retention means being spaced apart from each other by a substantial distance, said lower end of said elongate strips being attached to the upper of the shoe, wherein said upper loop means comprises a plurality of pairs of slits made either directly through the upper of the shoe or through an eyestay member affixed to the upper of the shoe, each of said pairs of slits being adjacent to and oriented generally parallel to the upper ends of said strips, and a strip retention lanyard looped between said plurality of said pairs of slits to thereby slideably retain the upper ends of said strips.

9. The shoe of claim 8, wherein said lower retention means comprises stitch means.

10. The shoe of claim 8, wherein said lower retention means comprises adhesive means.

11. The shoe of claim 8, wherein said lower retention means comprises a combination of stitch and adhesive means.

12. A lacing system for a shoe having an upper with a vamp, a quarter on each side of the shoe, a counter, and a sole, comprising;

a plurality of elongate strips, each strip having a lower portion, an upper portion, and a middle portion, said lower strip portion being rigidly attached to the quarter of the shoe in the vicinity of the sole of the shoe;

a plurality of lacing eye members, at least one of said lacing eye members being fixed at said upper portion of each of said strips; and a plurality of loop means, said plurality of loop means positioned near a top portion of the upper of the shoe, wherein each loop means comprises a pair of spaced apart parallel slits made through a loop member piece positioned along the central longitudinal axis of the hose, or directly through the quarter of the shoe, said pairs of slits being approximately perpendicular to said strips, whereby in use, each said strip is looped through and movably retained at its upper portion through said pair of slits of each loop means and wherein at least said middle portion of said strips lies unattached on the quarter of the shoe.

13. A lacing system for a shoe having an upper with a vamp, a quarter, and a counter, and a sole, comprising:

a plurality of elongate strips, each strip having a lower portion, an upper portion, and a middle portion, at least a portion of said middle portion of said plurality of elongate strips remaining unattached to the upper, the lower strip portion being attached to the quarter of the shoe above the sole of the shoe;

a lacing eye member affixed at said upper portion of each of said strips; and strip retention means positioned along the medial longitudinal axis of the shoe in order to retain said upper portions of said strips thereon in a predetermined alignment, independent of positioning thereon by a shoe lace.

* * * * *